US005410928A

United States Patent [19]

Bakermans et al.

[11] Patent Number: 5,410,928

[45] Date of Patent: May 2, 1995

[54] SCRAP REMOVAL SYSTEM FOR A STAMPING AND FORMING MACHINE

[75] Inventors: Johannes C. W. Bakermans; Daniel E. Poplaski, both of Harrisburg, Pa.

[73] Assignee: The Whitaker Corporation, Wilmington, Del.

[21] Appl. No.: 144,770

[22] Filed: Oct. 27, 1993

[51] Int. Cl.[6] ..... B26F 1/14

[52] U.S. Cl. ..... 83/155; 83/167; 83/687; 83/690

[58] Field of Search ..... 83/155, 155.1, 687, 83/693, 167, 100, 690

[56] References Cited

U.S. PATENT DOCUMENTS

| | | | |
|---|---|---|---|
| 2,489,559 | 11/1949 | Boyle | 83/100 |
| 3,589,221 | 6/1971 | Deegan | 83/620 |
| 3,789,711 | 2/1974 | Mead | 83/155 |
| 4,497,196 | 2/1985 | Bakermans et al. | 72/405 |
| 4,708,042 | 11/1987 | Jung | 83/112 |
| 4,809,576 | 3/1989 | Bakermans et al. | 83/155 |
| 4,819,476 | 4/1989 | Bakermans et al. | 72/456 |
| 5,007,282 | 4/1991 | Bakermans | 72/481 |

*Primary Examiner*—Kenneth E. Peterson

[57] ABSTRACT

A stamping and forming machine is disclosed having two operating modules, each of which has a unique scrap removal system. The machine includes a punch assembly and a mating die assembly that reciprocate horizontally toward and away from each other for performing stamping and forming operations. The die assembly includes a die plate having openings for mating with punches in the punch assembly, a die backup plate having scrap receiving openings, and a ram for effecting the reciprocating motion. An adapter is disposed between the die backup plate and the ram and is carried thereby. Horizontally disposed openings are formed in the adapter in corresponding alignment with the scrap receiving openings. Vertically disposed openings are formed in the bottom surface of the adapter and extend upwardly to intersect the horizontal openings. A conveyer is arranged vertically under these vertically disposed openings and leads to a position outside of the machine. During operation, scrap slugs formed during the stamping process are forced by the punches through the scrap receiving openings where they enter the horizontal openings and fall by gravity through the vertical openings to the conveyer and conveyed to the outside of the machine.

12 Claims, 8 Drawing Sheets

SCRAP REMOVAL SYSTEM FOR A STAMPING AND FORMING MACHINE

The Present invention relates to stamping and forming machines having one or more operational modules and more particularly to a scrap removal system for each individual module.

BACKGROUND OF THE INVENTION

U.S. Pat. Nos. 4,497,196 and 4,819,476 disclose a stamping and forming machine having first and second ram assemblies which are reciprocable toward and away from each other along horizontal paths of reciprocation. Strip material is fed along a strip feed path which extends between the ram assemblies. The ram assemblies have tooling on their ends for performing stamping and forming operations on the strip. The ram assemblies are reciprocated by oscillating levers to which the are coupled. The levers, in turn, are coupled to a central power shaft by eccentric assemblies. An example of such tooling is disclosed in U.S. Pat. No. 5,007,282 which sets forth a typical punch and die assembly for use in a stamping and forming machine, and which is incorporated herein by reference. Due to the intricacy of the stampings and the resulting density of such tooling it is often difficult to provide for removal of the scrap slugs. While conventional scrap removal systems in conventional vertically reciprocating presses are relatively simple and effective, such systems in a stamping and forming machine having horizontally reciprocating tooling assemblies require a very substantial amount of room and tend to weaken the die backup plate thereby limiting the effective tonnage that may be used, and reducing the life of the tooling. One scrap removal system that addresses this problem is disclosed in U.S. Pat. No. 4,809,576 which issued Mar. 7, 1989 to Bakermans et al. and which is incorporated herein by reference. The '576 patent discloses a die assembly for a stamping and forming machine that utilizes a moving belt in a chamber directly behind the die backup plate to pick up the scrap slugs and move them to a position outside of the tooling assembly. The surface of the belt is disposed perpendicular to the horizontal reciprocating movement of the punch and die tooling, and contains irregularities for engaging the stacks of scrap slugs that are pushed through the openings in the die backup plate thereby breaking the individual slugs away from the stacks and carrying them outside of the die assembly. This belt arrangement works well when stamping and forming operations are performed on relatively narrow stock. When it is desired to work with larger stock, two or more such scrap removal belts may be used, spaced apart so that a wall of solid material is present between every two belts to provide compressive strength in support of the die plate. This system works well but is limited to an operating tonnage of about 20 tons or so. As larger tonnage stamping and forming machines are developed, in the vicinity of about 60 tons, the belt chamber of such a scrap removal system would seriously compromise the integrity of the die backup plate. What is needed is a scrap removal system for high tonnage machines that provides efficient scrap removal while permitting sufficient die plate support.

SUMMARY OF THE INVENTION

A stamping and forming machine is disclosed of the type including a punch assembly having punches and a mating die assembly which are arranged to undergo reciprocating horizontal motion toward and away from each other for performing a stamping and forming operation on a workpiece disposed therebetween. The die assembly includes a die plate having die openings extending through opposite major surfaces. Each die opening is in alignment with a corresponding one of the punches. A backup plate is adjacent the die plate and has a scrap exit opening in alignment with a corresponding one of the die openings. A ram is provided for effecting the reciprocating horizontal motion of the die assembly. A scrap removal system is provided that includes an adapter plate between the backup plate and the ram arranged to reciprocate therewith. The adapter plate has a first face in engagement with the major surface of the backup plate opposite the die plate and a second face opposite the first face in engagement with the ram. First openings are spaced apart in the first face of the adapter plate in communication with the scrap exit openings, and extend substantially horizontally in a direction somewhat parallel with the horizontal reciprocating motion. Second openings are provided in a bottom surface of the adapter plate and extend substantially vertically from the bottom face into intersection with the first openings. A conveyer is disposed vertically under and in alignment with the second openings. The first and second openings and the conveyer are arranged so that when one of the punches blanks through the workpiece forcing a scrap slug into its corresponding die opening another scrap slug previously blanked is urged through a corresponding scrap exit opening in the backup plate and into and through a corresponding first opening where it falls by gravity through the intersecting second opening to the conveyer and is moved thereby to a position outside of the machine.

DESCRIPTION OF THE PREFERRED EMBODIMENT

Figure 1:
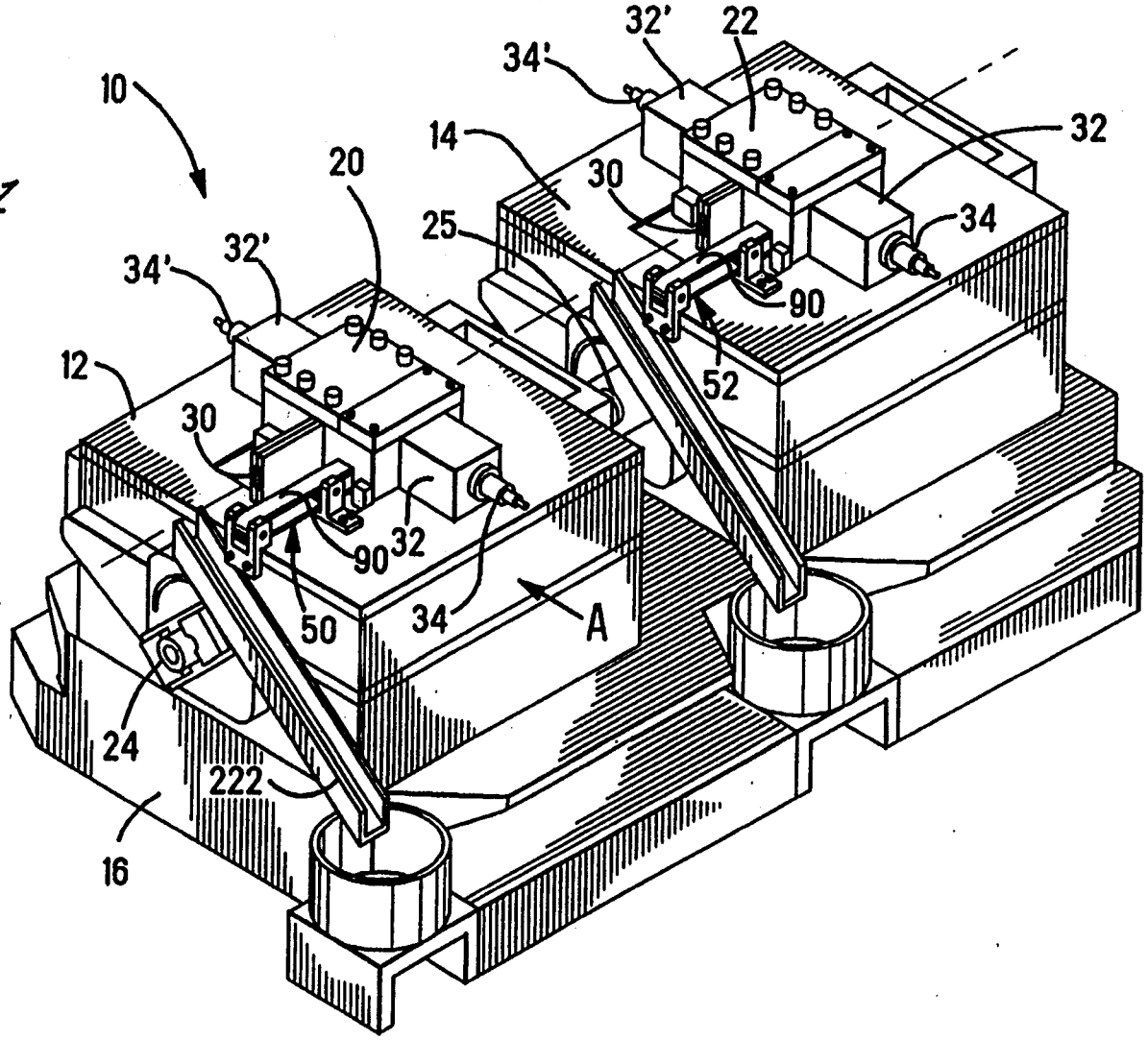
FIG. 1 is an isometric view of a two module stamping and forming machine incorporating the teachings of the present invention.
Figure 2:
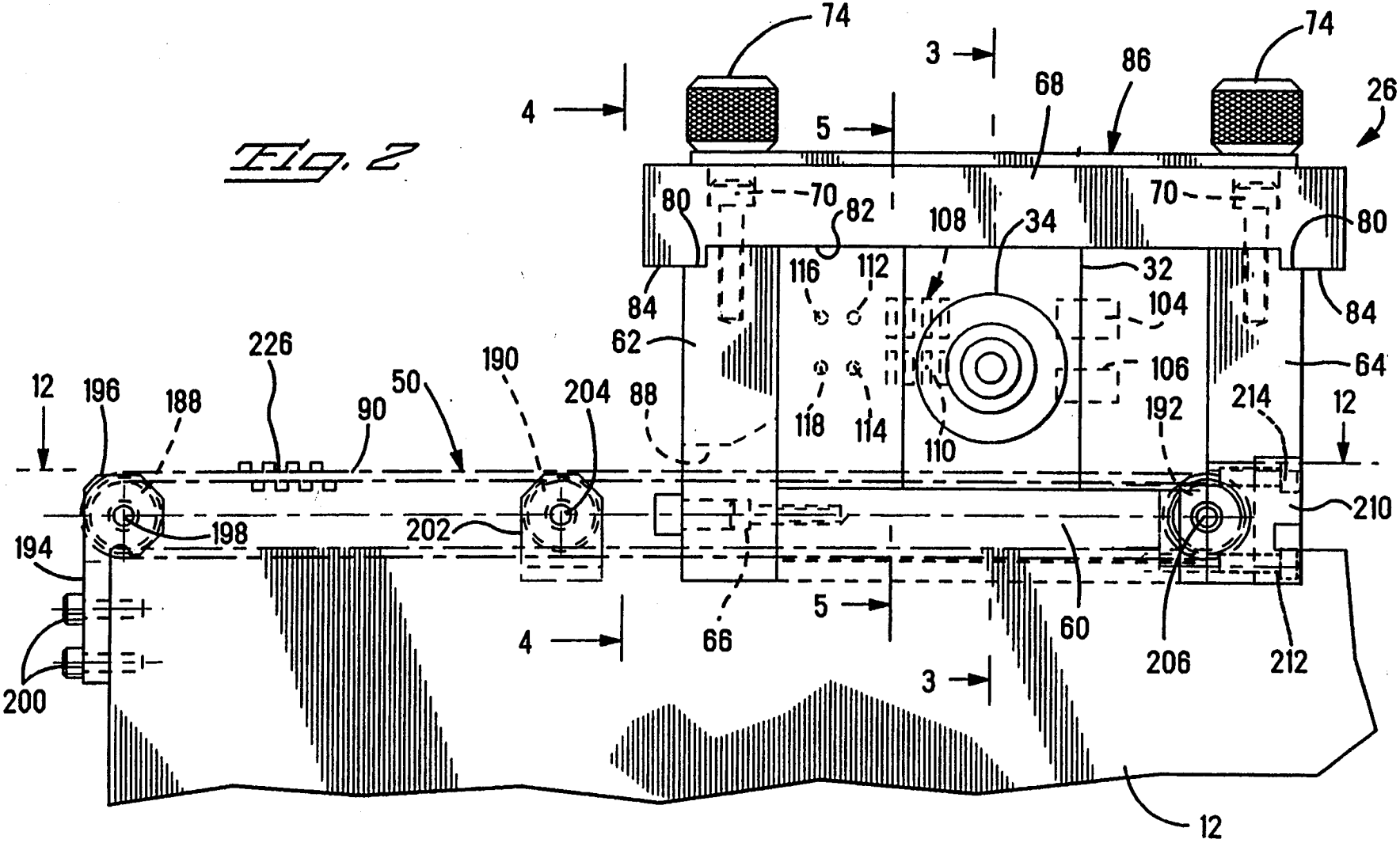
FIG. 2 is a partial front view taken along the direction of the arrow A in FIG. 1.
Figure 3:
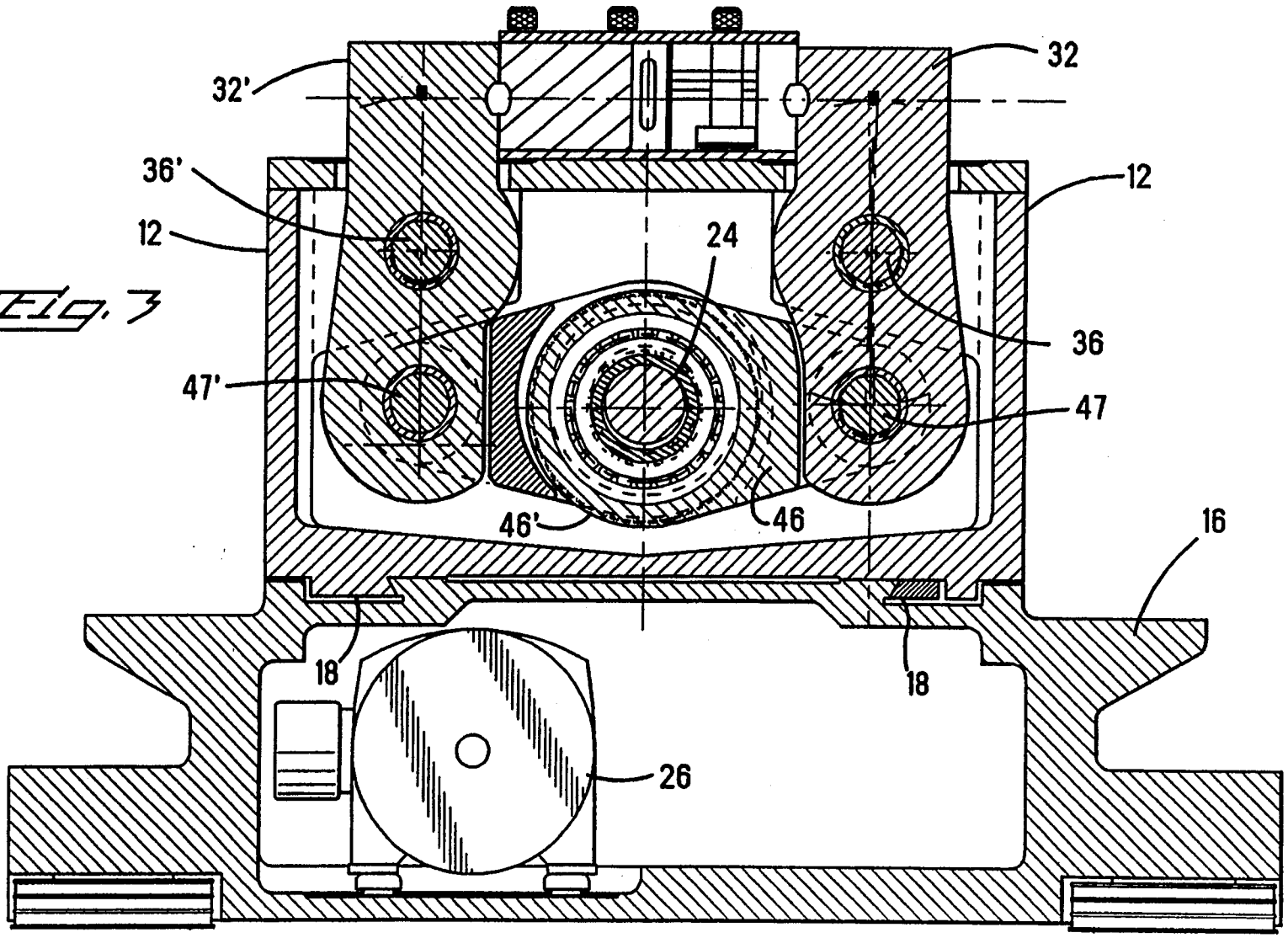
FIG. 3 is a partial cross-sectional view taken vertically through one of the modules shown in FIG. 1.

There is shown in FIGS. 1, 2, and 3 a stamping and forming machine 10 having a first stamping and forming module 12 and a second stamping and forming module 14. FIG. 2 is an end view of a portion of the module 12, as indicated by the arrow A in FIG. 1, while FIG. 3 is a cross section of the entire machine 10 taken along the lines 3—3 in FIG. 2. The first and second modules, 12 and 14, are mounted to a machine base 16 and arranged in ways 18, as best seen in FIG. 3, so that their relative spacing can be adjusted when the machine is set up for a particular job. This means of adjustment is provided to assure that the tooling in the first module will be in proper alignment with respect to the tooling in the second module so that a strip having operations performed on it in the first module will be in proper alignment in the second module for further operations there. The modules 12 and 14 have first and second tooling assemblies 20 and 22, respectively, mounted to their top mounting plates, as shown in FIG. 1. Each module has a drive shaft 24 and an electric motor 26 for rotating the drive shaft during operation of the machine. The motor is coupled to the drive shaft 24 by means of a belt and pulley in the usual manner. The two drive shafts 24 are rotationally coupled together by a coupling assembly 25. Each tooling assembly 20 and 22 includes a-pair of opposing ram assemblies which contain tooling on their ends which mate to perform the stamping and forming operation on strip stock that is fed through aligned slots 30. The opposing ram assemblies of each module are arranged to reciprocate toward and away from each other along horizontal paths. The rams are caused to reciprocate by means of first and second levers 32 and 32' which are coupled to their respective rams as shown at 34 and 34'. Each lever 32, 32' is pivoted intermediate its ends at 36 and 36' and its lower end is pivoted at 47, 47' to the drive shaft 24 by means of a pair of eccentrically coupled links 46 and 46'. Scrap removal systems 50 and 52 are associated with the first and second tooling assemblies 20 and 22, respectively, as shown in FIG. 1, to remove scrap slugs formed during operation of the machine.

Figure 4:
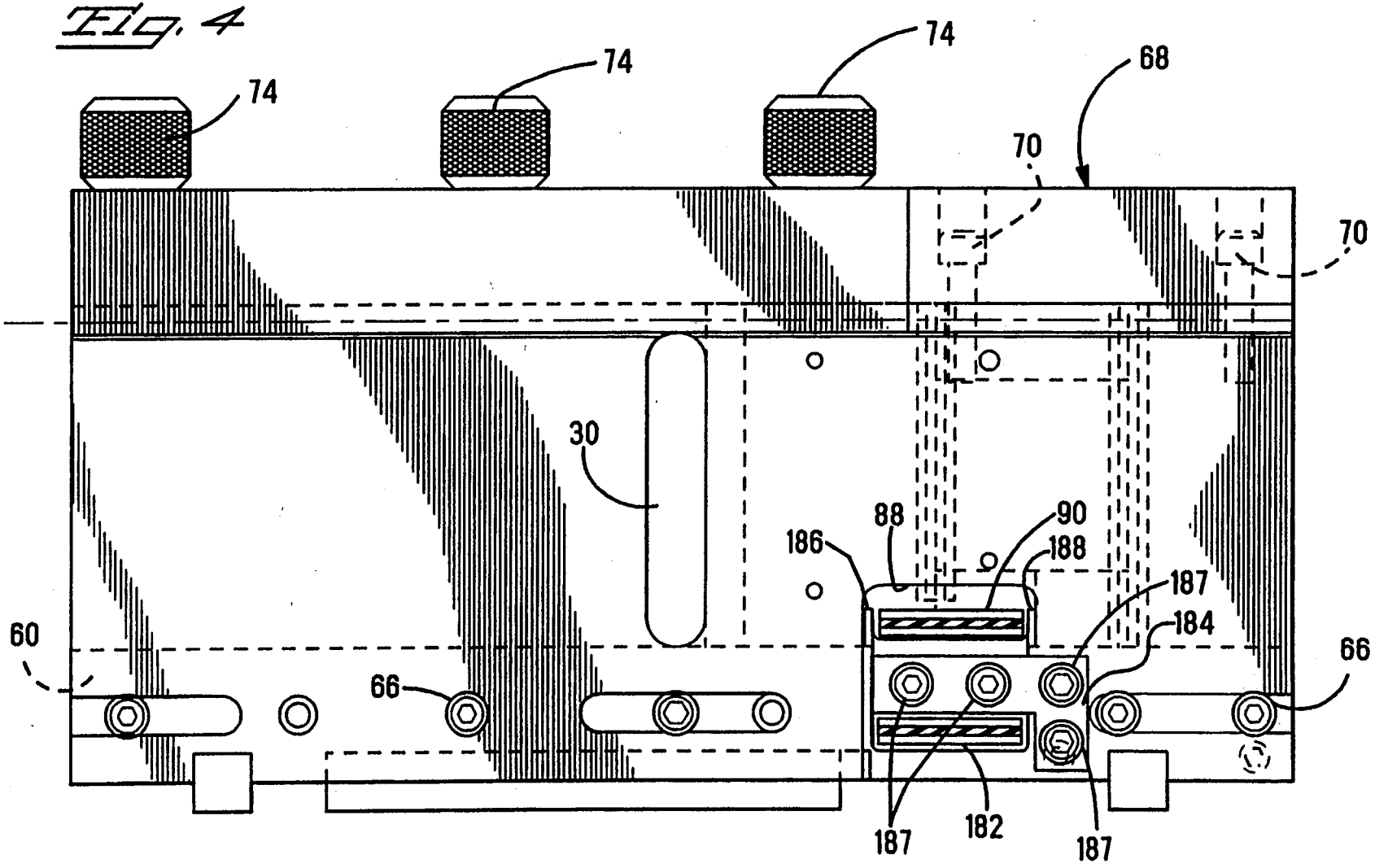
FIG. 4 is a partial cross-sectional view taken along the lines 4—4 of FIG. 2.

The tooling assembly 20 will now be described in more detail including its scrap removal system 50. It will be understood that the tooling assembly 22 and scrap removal system 52, although not identical, are arranged and function in a similar manner as the tooling assembly 20 and scrap removal system 50 and therefore will not be described here. The tooling assembly 20, as best seen in FIG. 2, includes a base 60 keyed and secured to the module 12 by screws in the usual manner. A front plate 62 and a rear plate 64 are bolted to opposite edges of the base 60 by means of the screws 66. A top plate 68 is attached to the top edges of the front and rear plates by means of four screws 70. The top plate 68 only covers a portion of the top edges of the front and rear plates 62 and 64, as best seen in FIG. 4. The remaining portion is covered by a cover plate 72 which is removably attached to the top edges of the front and rear plates by six thumb screws 74, as shown in FIGS. 2 and 4. The outer top edges of both the front and rear plates 62 and 64 have rabbets 80 formed therein, as best seen in FIG. 2. Both the top plate 68 and the cover plate 72 have recessed surfaces 82 that form flanges 84 that snugly fit into the rabbets 80 for locating purposes. The base 60, front and rear plates 62 and 64, top plate 68, and cover plate 72 form a box structure 86 within which the punch and die assemblies of the first tooling assembly 20 reciprocate.

Figure 6:
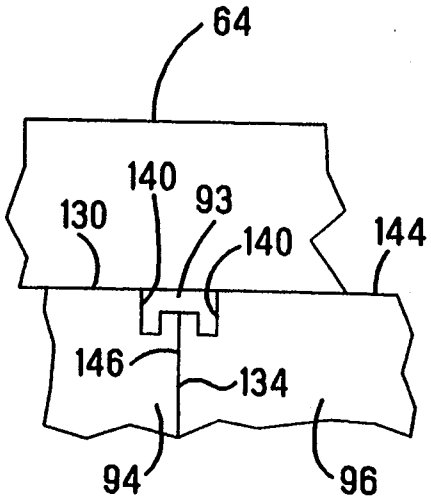
FIG. 6 is a partial cross-sectional view taken along the lines 6—6 of FIG. 5.
Figure 5:
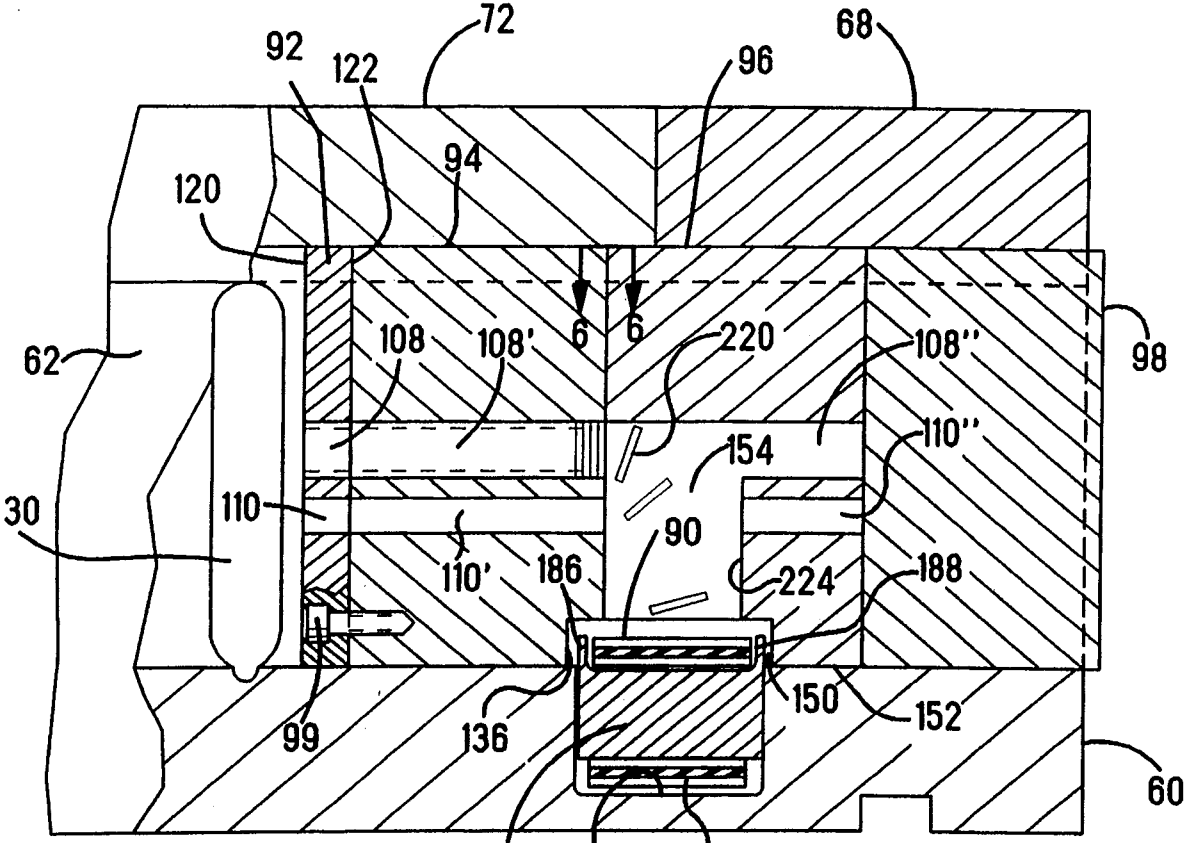
FIG. 5 is a partial cross-sectional view taken along the lines 5—5 of FIG. 2.
Figure 7:
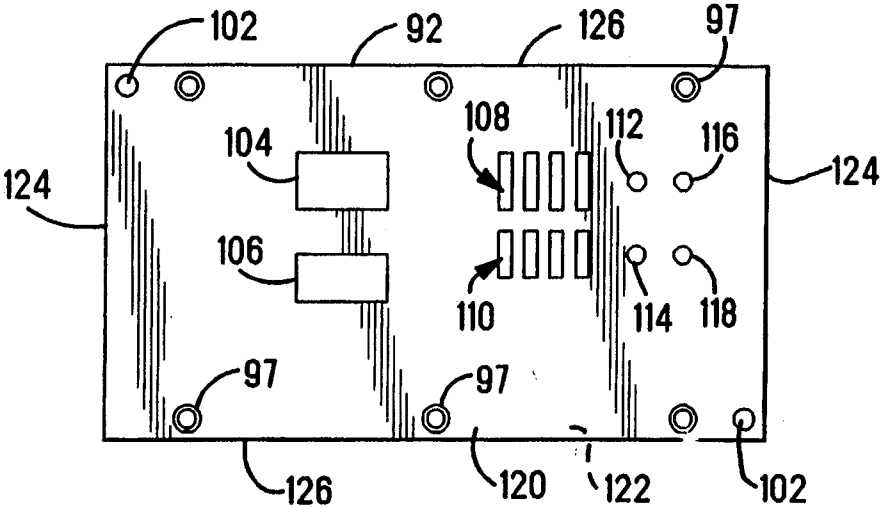
FIG. 7 is a plan view of the die plate shown in FIG. 5.
Figure 9:
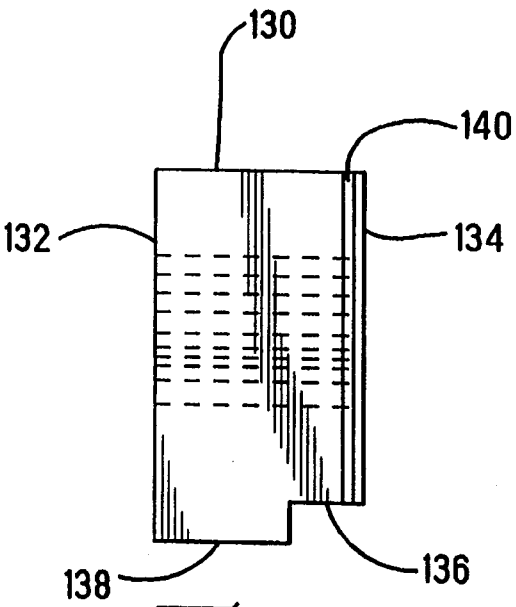
FIGS. 8 and 9 are plan and side views, respectively, of the die backup plate shown in FIG. 5.
Figure 8:
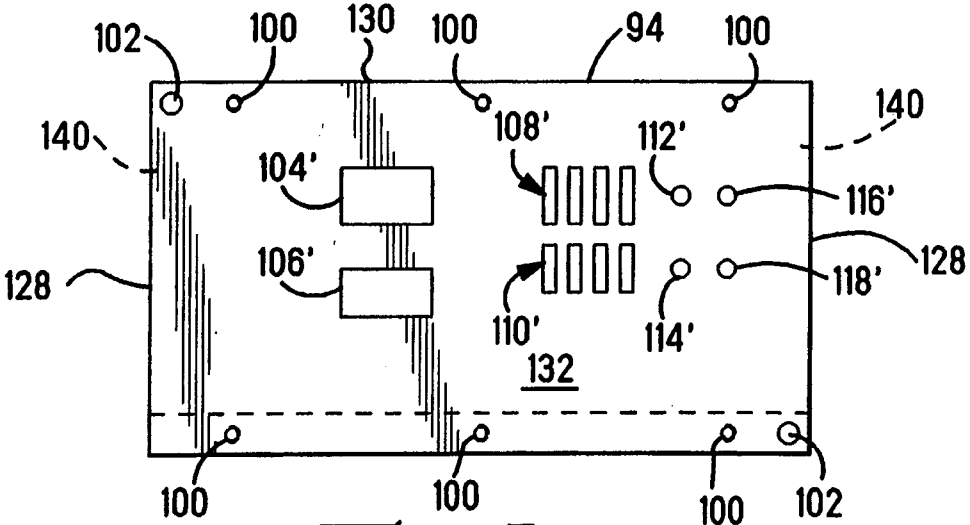

As shown in FIGS. 2 and 4 the front plate 62 has an opening 88 formed therein for clearance for a scrap removal belt 90 that is part of the scrap removal system 50. This system will be described in detail below. The scrap removal system 50 is related to only the die assembly of the first tooling assembly 20, therefore, the punch assembly will not be described here. More detail information of a typical punch assembly is disclosed in the above referenced U.S. Pat. No. 5,007,282. The die assembly, as best seen in FIG. 5 includes a die plate 92, a die backup plate 94, an adapter 96, and a ram 98. The die backup plate, adapter, and ram are all keyed together with keys 93, as shown in FIG. 6, on opposite edges of their adjoining faces. This allows the backup plate and the adapter to follow the ram when it is retracted to the right, as viewed in FIG. 5, during reciprocation thereof. The die plate, as shown in FIG. 7, includes counterbored holes 97 for receiving screws 99 that engage threaded holes 100 formed in the die backup plate 99 as shown in FIGS. 8 and 9. A pair of dowel pins, not shown, are arranged in holes 102 formed in diametrically opposite corners of the die plate and backup plate for accurate alignment of the two plates. As shown in FIG. 7, several punch openings are arranged in the die plate as a simple hypothetical example of one possible blanking pattern for discussion purposes. The openings include two rectangular openings 104 and 106 in vertical alignment, two rows 108 and 110 of four rectangular openings each, both rows being in vertical alignment, and four round holes 112 through 118, two of the holes 112 and 114 being in vertical alignment and the other two holes 116 and 118 being in vertical alignment. All of the openings extend completely through the die plate from the major surface 120 to the major surface 122. The outer edges 124 and 126 of the die plate 92 are square and dimensioned for a slip fit with the inside of the box structure 86. The die backup plate 94, as shown in FIGS. 8 and 9, has sides 128 and 130 that are square and dimensioned for a slip fit with the inside of the box structure. A major surface 132 of the die backup plate 94 is held securely against the major surface 122 of the die plate 92 by the screws 99. The die backup plate 94 includes scrap exit openings 104' through 118' that correspond to and are in alignment with the punch openings 104 through 118, respectively, in the die plate 92. However, the scrap exit openings are slightly larger to allow the scrap slugs to pass through without too much interference, as is common in punch and die structures. These openings 104' through 118' extend completely through the die backup plate from the major surface 132 to an opposite major surface 134, shown in FIG. 9. A clearance cutout 136 is formed in the bottom surface 138 and intersects the major surface 134 of the die backup plate to provide clearance for the scrap removal belt 90 and related structure. A keyway 140 is provided along two opposite edges of the major surface 134 for receiving the keys 93 for coupling the die backup plate 94 to the adapter 96, as shown in FIG. 6.

Figure 11:
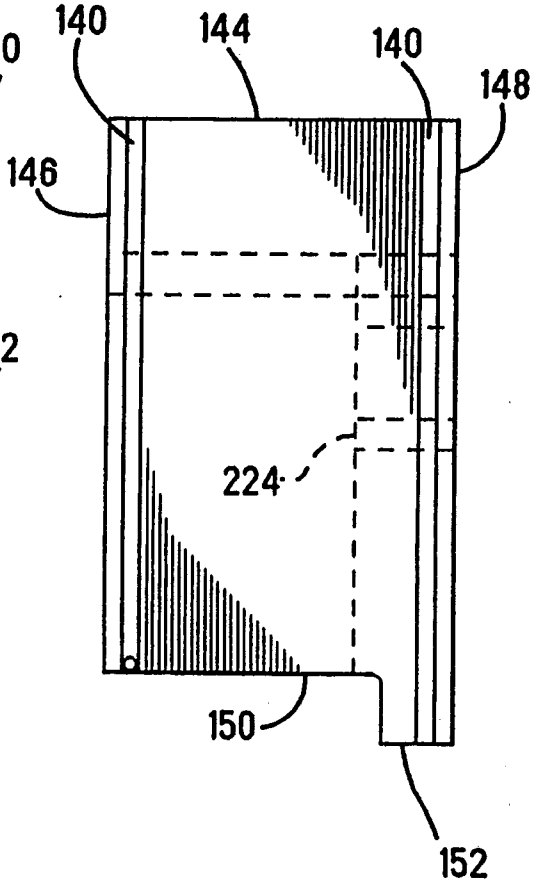
FIGS. 10 and 11 are plan and side views, respectively, of the adapter plate shown in FIG. 5.
Figure 10:
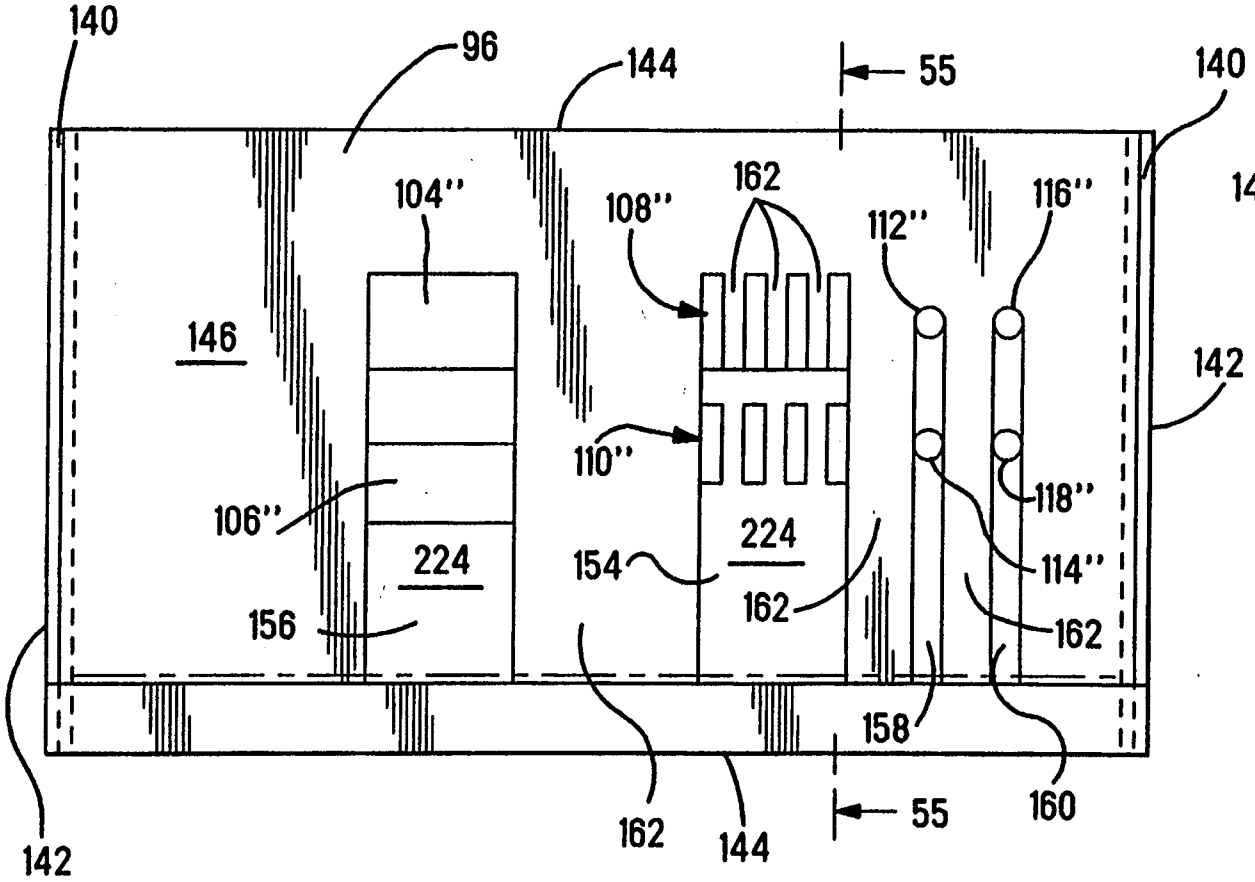

The adapter 96, as shown in FIGS. 10 and 11, has sides 142 and 144 that are square and sized to be a slip fit with the inside of the box structure 86, similar to the die plate and the die backup plate. A major surface 146 of the adapter is held against the major surface 134 of the die backup plate 94 by means of the two keys 93 in keyways 140 formed in the major surface 146 adjacent the sides 142. The adapter 96 includes another major surface 148 opposite the major surface 146 having two keyways 140 formed therein adjacent the sides 142. This major surface 148 is held against the ram 98 by means of another pair of keys 93 in a similar manner. A clearance cutout 150 is formed in the bottom surface 152 and intersects the major surface 146 of the adapter to provide clearance for the scrap removal belt 90 and related structure. The adapter 96 includes first openings 104" through 118" that correspond to and are in alignment with the scrap exit openings 104' through 118', respectively, in the die backup plate 94. The first openings extend horizontally in a direction parallel with the direction of reciprocation and are substantially identical in size and shape to the scrap exit openings and in alignment therewith. These openings 104" through 118" extend completely through the adapter from the major surface 146 to an opposite major surface 148, shown in FIG. 10. As will be noted, FIG. 5 is a cross section taken along the lines 5—5 in FIG. 2 and is cut through the left most openings 108 and 110. For additional clarity, section lines 55—55 are shown in FIG. 10 which also correspond to the view of the adapter shown in FIG. 5. A second opening 154 extending upwardly from the bottom surface 144 is in communication with the two rows 108" and 110" of first openings, as shown in FIGS. 5, 10, and 11. The second opening is of substantially the same width as or slightly larger than the widths of the rows of first openings. As is shown, the second opening 154 is substantially vertically disposed under the openings 108" and 110" and it intersects the cutout 150. Similarly, a second opening 156 extends from the cutout 150 into communication with the first openings 104" and 106" and is the same width as these openings or slightly larger. Additionally, second openings 158 and 160 extend from the cutout 150 into communication with the first openings 112" 114" and 116" 118" respectively Adjacent first and second openings form solid walls 162 therebetween that extend from the surface 146 to the surface 148. These solid walls are important in that they transmit the high compressive forces from the ram 98 to the die backup plate with a minimum of deflection of the adapter. In the event that the rows 108" and 110" were longer resulting in the width of the second opening 154 being too great, the rows of first openings may be divided into groups and a second opening 154 may be extended from the cutout 150 to each group, thereby leaving a solid wall 162 between each of the groups.

Figure 12:
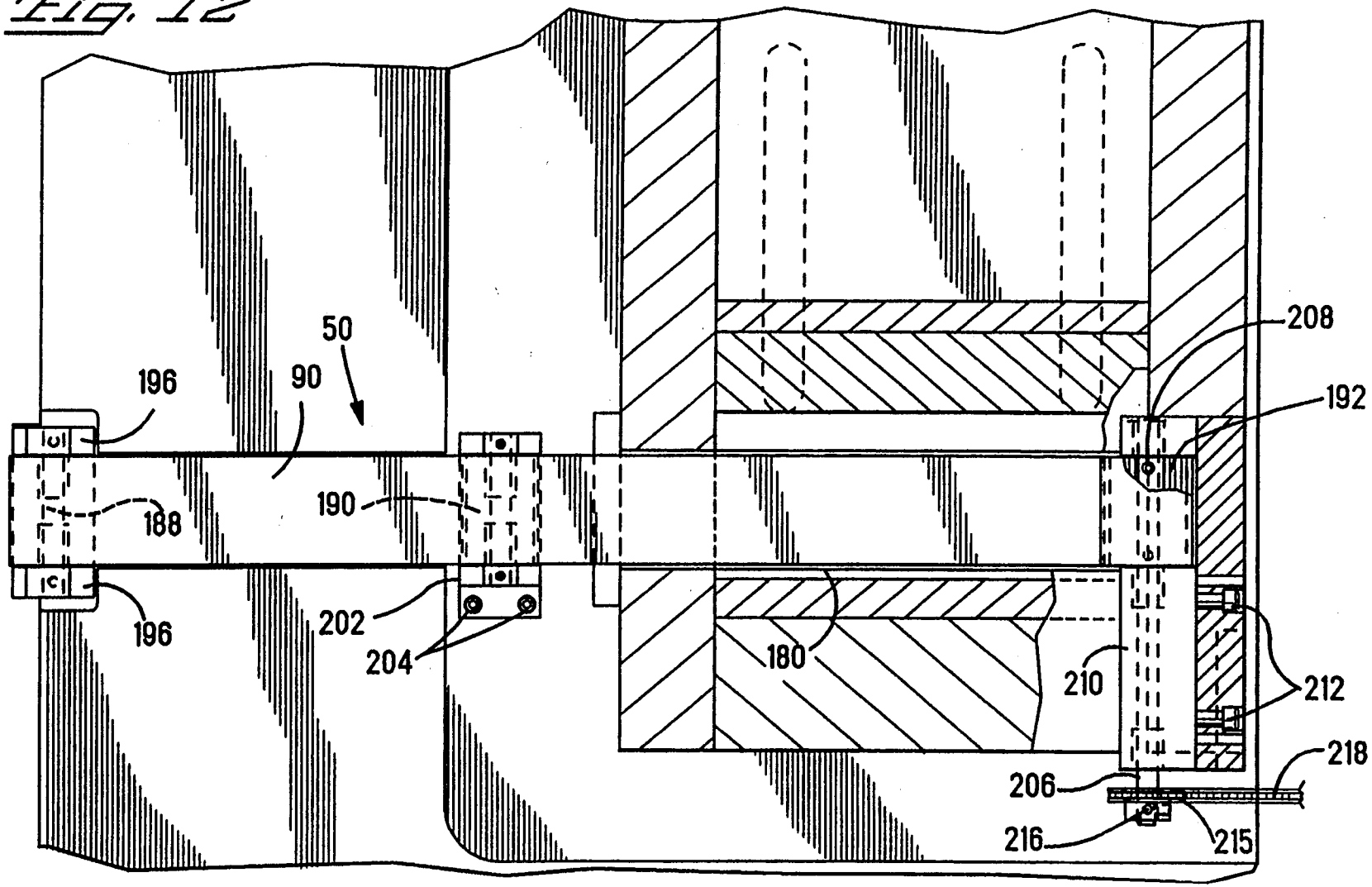
FIG. 12 is a partial cross-sectional view taken along the lines 12—12 of FIG. 2.

As shown in FIGS. 4, 5, and 12 the cutouts 136 and 150 provide clearance for the scrap removal system 50. A bar 180 running substantially the width of the box structure 86, as viewed in FIG. 2, is shown disposed in a groove 182 formed in the base 60 that is perpendicular to the direction of reciprocating motion of the die assembly. The bar 180 includes a pair of upwardly facing walls 186 and 188 that are on opposite sides of the bar thereby forming a tray that is disposed within the cutouts 136 and 150, as best seen in FIGS. 4 and 5. The scrap belt 90 is arranged around the bar 180 so that the top of the belt is between the walls 186 and 188 within the tray, and the bottom of the belt is between the bottom of the bar 180 and the bottom of the groove 182 with clearance therebetween. The bar 180 is attached to the front plate 62 by means of a bracket 184 and four screws 187 threaded into holes in the front plate. As shown in FIGS. 2 and 12 the scrap belt is supported at three places, by two idler pulleys 188 and 190 and by a drive pulley 192. The pulley 188 is journaled for rotation in a bracket 194 having a pair of opposite side flanges 196 through which a shaft 198 extends. The bracket 194 is attached to the module 12 with screws 200, as shown in FIG. 2. The idler pulley 190 is journaled for rotation in a U-shaped bracket 202 by means of a shaft 204. The bracket is attached to the top of the module 12 by means of two screws 204. The drive pulley 192 is attached to a drive shaft 206 by means of set screws 208. The drive shaft 206 is journaled for rotation in a block 210 that is attached to the base 60 by means of two screws 212 and to the rear plate 64 by means of two screws 214. A sprocket 215 is attached to the end of the drive shaft 206 by means of a set screw 216. A drive chain 218, in driving engagement with the sprocket, is coupled to the stock feed mechanism of the machine 10 for driving the scrap belt at a speed that is proportional with the speed of feed. In this way, as the speed of stock feed is changed for various applications, the speed of scrap removal will change correspondingly.

In operation, the punch and die assemblies reciprocate toward and away from each other performing stamping and forming operations on the strip of stock, not shown, that is fed through the opening 30. As the die assembly undergoes this reciprocating movement, the scrap removal system remains stationary with respect to the machine 10. As shown in FIG. 5, there is sufficient clearance between the walls of the cutouts 136 and 150 to prevent interference with the walls 186 and 188 of the bar 180. Additionally, the second openings 154 through 160 are arranged so that they remain vertically above the belt 90 during this reciprocating movement. As operation of the machine 10 continues, scrap slugs 220 begin to accumulate and fill up the die openings 108 and the scrap exit openings 108' in the backup plate 94, as shown in FIG. 5. As scrap slugs 220 pass completely through the scrap exit opening 108' they enter the first opening 108" and fall by gravity through the second opening 154 to the top surface of the belt 90 and are carried to a discharge shoot 222 outside of the machine 10, as best seen in FIG. 1. Occasionally, bridging occurs where individual slugs stick together and begin to bridge across the second opening 154. Some of the slugs 220 form a stack that projects along a curved path across to the back wall of the second opening 154. In such case, the end of the curved stack will either engage the belt 90 and break free or it will be forced against the back wall of the second opening causing it to buckle so that it breaks free. In both cases the stack of slugs will fall by gravity to the belt 90 and be carried out.

It will be understood that the first openings 104" through 118" need not pass completely through the adapter 96 but may terminate in the back wall 224 of their respective second openings 154 through 160. Although, it is more costly to manufacture such blind holes. The surface of the scrap belt 90, in the present example, includes lateral grooves 226 or pockets, as seen in FIG. 2, that help to hold the scrap slugs on the belt until they are transported outside of the machine, however, other surfaces including a smooth surface may be advantageously utilized in the practice of the present invention.

An important advantage of the present invention is that more support material is provided between the ram and the die backup plate than is possible with prior art scrap removal systems. This permits the use of the die assembly in higher tonnage presses than would otherwise be possible. Additionally, the unique structure of the tray and the belt being contained within the walls of the tray positively prevent inadvertent passage of the slugs into the cutouts 136 and 150 where possible damage to the tooling or machine may occur.

We claim:

1. In a stamping and forming machine of the type including a punch assembly having punches and a mating die assembly, each of said assemblies being arranged to undergo reciprocating horizontal motion toward and away from each other for performing a stamping and forming operation on a workpiece disposed therebetween, wherein said die assembly includes a die plate having die openings extending through opposite major surfaces, each die opening in alignment with a corresponding one of said punches, a backup plate adjacent said die plate having a scrap exit opening in alignment with a corresponding one of said die openings, and a ram for effecting said reciprocating horizontal motion of said die assembly, a scrap removal system comprising:

(a) an adapter plate between said backup plate and said ram arranged to reciprocate therewith and having a first face in engagement with a major surface of said backup plate opposite said die plate and a second face opposite said first face in engagement with said ram;

(b) first openings spaced apart in said first face of said adapter plate in communication with said scrap exit openings, said first openings extending substantially horizontally in a direction somewhat parallel with said horizontal reciprocating motion;

(c) second openings in a bottom surface of said adapter plate, each said second openings extending substantially vertically from said bottom surface into intersection with a first opening; and (d) a conveyer disposed vertically under and in alignment with said second openings, said first and second openings and said conveyer arranged so that when one of said punches blanks through said workpiece forcing a scrap slug into its corresponding die opening another scrap slug previously blanked is urged through a corresponding scrap exit opening in said backup plate and into and through a corresponding first opening where it falls by gravity through said intersecting second opening to said conveyer and is moved thereby to a position outside of said machine.

2. The machine according to claim 1 wherein said first openings in said adapter plate are spaced apart to form solid walls therebetween so that at least a portion of each wall extends from said first face to said second face for transmitting compressive forces from said ram to said backup plate and to said die plate.

3. The machine according to claim 2 wherein each said portion of said wall includes a longitudinal axis that is substantially perpendicular to said first and second faces.

4. The machine according to claim 2 wherein said first openings in said adapter plate extend completely therethrough and intersect said second face.

5. The machine according to claim 2 wherein each said second opening extends from said bottom surface of said adapter only to a said first opening.

6. The machine according to claim 2 wherein said conveyer includes an endless belt for receiving said scrap slugs.

7. The machine according to claim 6 wherein said belt includes spaced apart slug receiving pockets in its outer surface for receiving and holding said scrap slugs during said movement thereof to said point outside of said machine.

8. The machine according to claim 6 including a belt passageway formed in said bottom surface of said adapter plate perpendicular to said reciprocating motion, and a tray within said belt passageway positioned vertically under said second openings, and wherein said belt is arranged to move within said tray along a length of said belt passageway to a position outside of said machine.

9. The machine according to claim 8 wherein said tray and said conveyer are attached to said machine and said belt passageway is wide enough to accommodate said reciprocating movement of said adapter plate without interference with said tray.

10. The machine according to claim 9 wherein said second openings are positioned in said bottom surface of said adapter so that said second openings are always vertically above said tray during said reciprocating motion of said adapter.

11. The machine according to claim 10 wherein said tray includes a pair of vertically disposed walls extending from a bottom thereof, said belt being disposed between said pair of walls, wherein said second openings are always vertically above said belt during said reciprocating motion of said adapter.

12. The machine according to claim 8 wherein said tray includes a pair of spaced vertically extending side walls and wherein said belt is between said side walls so that said side walls extend above said belt.

* * * * *